US005647786A

United States Patent [19]

Caspescha

[11] Patent Number: 5,647,786

[45] Date of Patent: Jul. 15, 1997

[54] STUFFED PERSONAL COMPUTER TOY

[76] Inventor: George L. Caspescha, 18 Weston Dr., Mohnton, Pa. 19540

[21] Appl. No.: 536,092

[22] Filed: Sep. 29, 1995

[51] Int. Cl.[6] ..... A63H 33/10; A63H 33/30

[52] U.S. Cl. ..... 446/85; 446/143; 446/479; 40/538

[58] Field of Search ..... 446/85, 408, 479, 446/143, 220, 901; D14/100; D6/601, 597; 5/636, 490; 472/81, 85, 57; 40/538

[56] References Cited

U.S. PATENT DOCUMENTS

D. 297,140 8/1988 Milliman ..... D14/100

3,636,654 1/1972 Workman ..... 446/408

4,888,837 12/1989 Wang ..... 446/220 X 4,973,287 11/1990 Martin ..... 446/479

*Primary Examiner*—Mickey Yu

*Attorney, Agent, or Firm*—Goldstein & Associates

[57] ABSTRACT

A stuffed personal computer toy, having a simulated processing unit, a simulated monitor, and a simulated keyboard, all of which are constructed of a soft material and provide the appearance of complementary functional components of a functional personal computer. The monitor and keyboard are attached to the processing unit using detachable fastening mechanisms so that they may be separated from the processing unit, and then reassembled.

5 Claims, 3 Drawing Sheets

STUFFED PERSONAL COMPUTER TOY

BACKGROUND OF THE INVENTION

The invention relates to a stuffed personal computer toy. More particularly, the invention relates to a stuffed toy having the shape and appearance of a personal computer, and further having detachable keyboard and monitor components.

U.S. Pat. No. Des. 294,721 to Cowling discloses an ornamental design for a stuffed toy computer doll. From the illustrations, it is clear that Cowling discloses a personified computer doll, which has legs, arms, and a face.

Several U.S. Patents disclose dolls having various attachable and detachable components. U.S. Pat. No. 3,434,232 to Tarrson discloses a take-apart simulated facial toy, which enables partial disassembly by allowing various portions of the toy face to be removed. U.S. Pat. No. 4,579,537 to Leahy discloses a take apart doll, in which the various body components may be held together by VELCRO-brand fastening tape. U.S. Pat. No. 5,344,355 to Silverstein discloses a toy doll having a detachable pacifier. U.S. Pat. No. 5,344,356 to Pizellie et al. discloses a decorative toy having detachable storage areas.

Several other U.S. Patents disclose construction sets which allow for attachment and detachment of various structural members. U.S. Pat. No. 3,939,600 to Eid discloses a take apart toy which can be configured to resemble a car, a truck, an airplane, or the like. U.S. Pat. No. 4,775,350 to Short et al. discloses a take apart toy structure having structural members which allow for the production of a variety of geometric structures, including geodesic designs.

Still other U.S. Patents disclose functioning toys which are designed to resemble personal computers. U.S. Pat. No. 4,536,164 to Klawitter discloses a toy computer in which its components may be initially snapped together. U.S. Pat. No. 5,055,053 to Hyman also discloses a functioning computer toy.

While these units may be suitable for the particular purpose employed, or for general use, they would not be as suitable for the purposes of the present invention as disclosed hereafter.

SUMMARY OF THE INVENTION

It is an object of the invention to produce a stuffed computer toy constructed of soft materials so that a user can either hug, kick, throw or punch it, to express the user's particular feeling toward their actually functioning personal computer, without causing damage to the toy or to nearby objects.

It is another object of the invention that the computer toy has non-functioning simulated processing unit, monitor and keyboard components which may be placed in an assembled position, where they fully provide the appearance of a functioning personal computer.

It is a further object of the invention that the simulated processing unit, monitor and keyboard components are detachable, so that they may be separated by the user.

It is a still further object of the invention that the simulated processing unit, the monitor, and the keyboard are attached to each other using hook and loop fasteners, so that the processing unit, monitor and keyboard of the toy may be "ripped apart" by a user feeling frustrated with their functioning personal computer, but then may be easily restored to the assembled position.

The invention is a stuffed personal computer toy, comprising a simulated processing unit, a simulated monitor, and a simulated keyboard, all of which are constructed of a soft material and provide the appearance of complementary functional components of a functional personal computer. The monitor and keyboard are attached to the processing unit using detachable fastening means so that they may be separated from the processing unit, and then reassembled.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
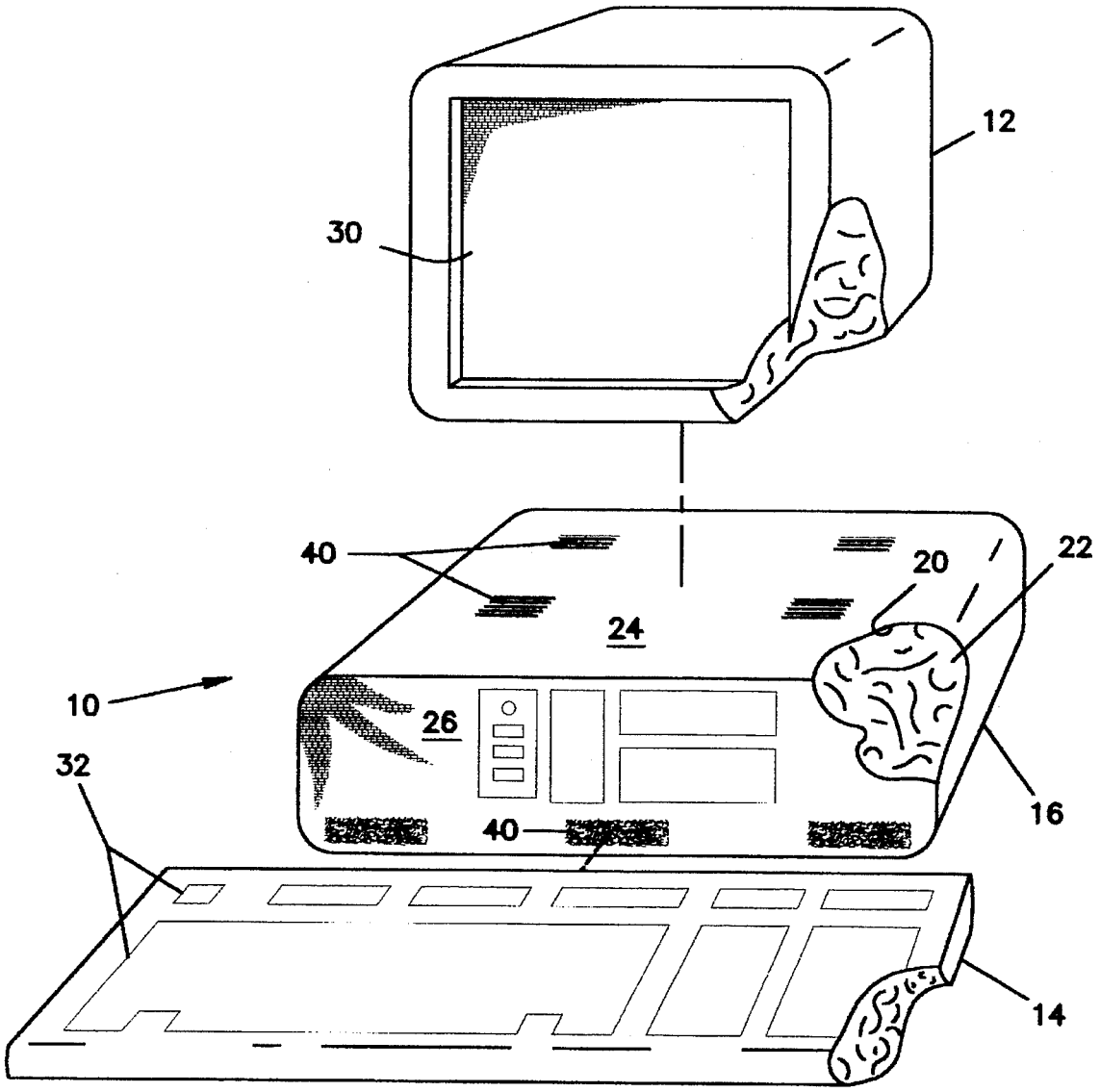
FIG. 1 is a diagrammatic perspective view illustrating the various components of the instant invention, ready to be assembled. Portions of each of the components have been removed to show internal detail.

FIG. 1 illustrates a stuffed personal computer toy 10, comprising simulated computer components, including a simulated monitor 12, a simulated keyboard 14, and a simulated processing unit 16. Each of the simulated computer components is non-functioning and is constructed of a soft material, so that it may be easily hit, punched, kicked, hugged, or thrown without being damaged or causing damage to other objects. To this end, the simulated computer components may have an outer skin 20 which encloses stuffing material 22. Preferably, the outer skin 20 would be made of fabric or plastic, and the stuffing material would be polyester stuffing. Alternatively, each of the simulated computer components may be cast of a solid piece of a foam-like material.

The processing unit 16 is substantially the shape of a rectangular prism, and resembles the processing unit or CPU of a typical functioning personal computer. Thus, the processing unit 16 has a top surface 24 upon which the monitor 12 is mounted, and has a front surface 26 transverse to the top surface 24, the front surface 26 having surface details which resemble those present on typically functioning personal computers, such as simulated drive bays 28.

The monitor 12 is substantially cubical in shape, and resembles a functioning monitor from a typical personal computer. Thus, the monitor 12 has a cathode ray tube indent 30 which resembles the CRT normally seen in front of a typical functional monitor.

The keyboard 14 is substantially wedge shaped, and resembles the keyboard of a typical functional personal computer. Therefore, the keyboard 14 may have key indicia 32 which outlines areas where either individual keys or blocks of keys would be present on an actually functioning personal computer keyboard.

Detachable fastening mechanisms 40 are used to attach the monitor 12 to the top surface 24 of the processing unit 16, and to attach the keyboard 14 to the front surface 26 of the processing unit 16, The detachable fastening mechanisms 40 may comprise hook and loop fastener components, commonly sold under the trademark VELCRO. Thus, as illustrated in FIG. 1, hook or loop fastener components are mounted to the top surface 24 and front surface 26 of the processing unit.

Figure 2A:
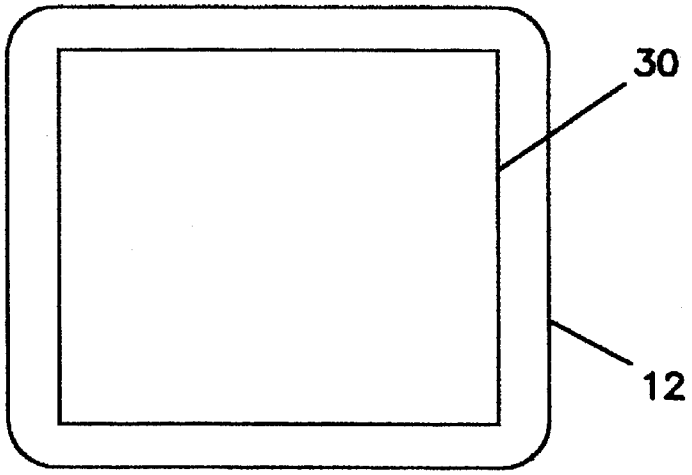
FIG. 2A is a front elevational view of a simulated monitor component of the instant invention.
Figure 2B:
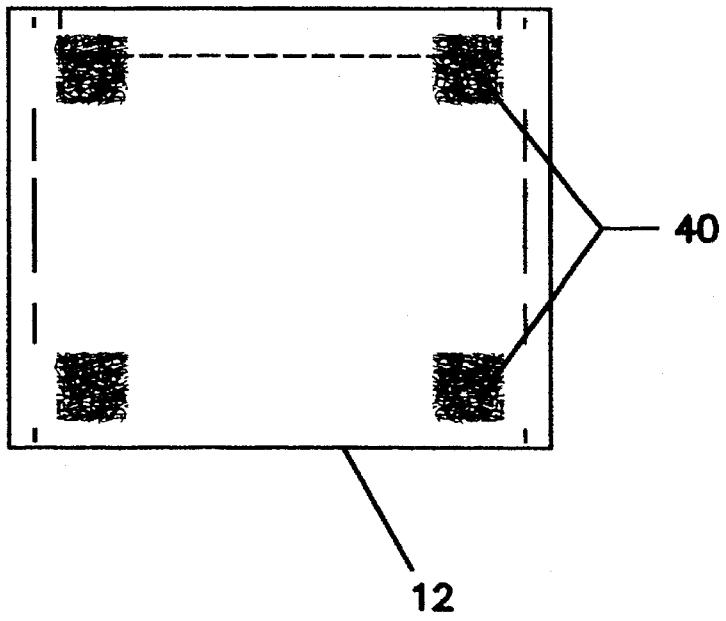
FIG. 2B is a bottom plan view of the simulated monitor component of the instant invention, illustrating a mechanism for attaching the monitor component to other components of the invention.

FIG. 2A is a front elevational view depicting the monitor 12, and its cathode ray tube indent 30. FIG. 2B is a bottom elevational view, illustrating how the detachable fastening mechanism 40 is attached beneath the monitor 12. Either hook or loop fastener components are used, depending on which is required to mate with the type of fastener components present on the top surface 24 of the processing unit 16.

Figure 3A:
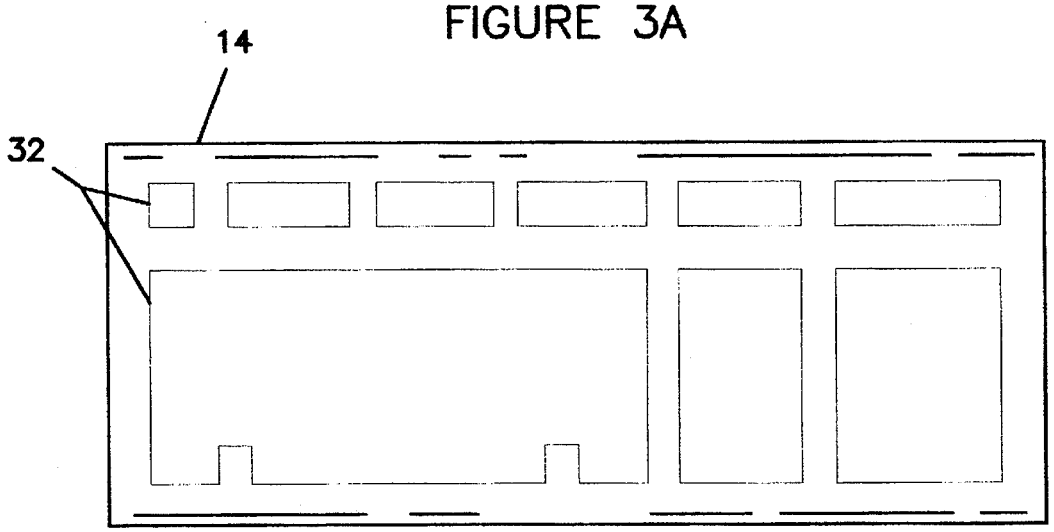
FIG. 3A is a top plan view of a simulated keyboard component of the instant invention.
Figure 3B:
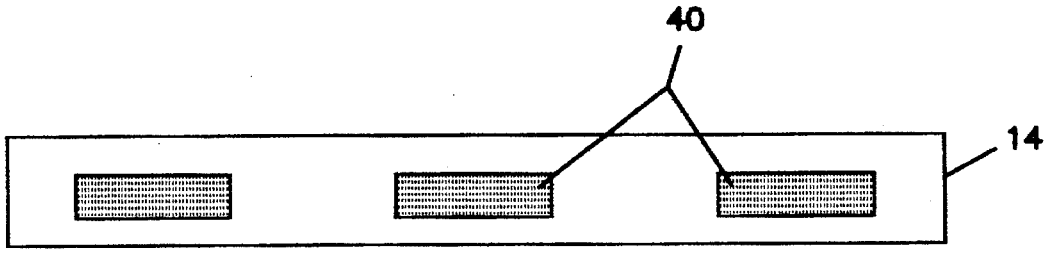
FIG. 3B is a rear elevational view of the simulated keyboard component, illustrating a mechanism for attaching the keyboard component to other components of the invention.

FIG. 3A is a top plan view depicting the keyboard 14. As illustrated, several blocked areas are combined to form the key indicia 32, so that the keyboard 14 more fully provides the appearance of the functioning keyboard of an actual personal computer. FIG. 3B is a rear elevational view, illustrating the presence of the detachable fastening mechanism 40 on the keyboard 14. Either hook or loop fastener components are present on the keyboard 14, depending on which type is required to mate with the type of fastener components present on the front surface 26 of the processing unit 16.

Thus, the stuffed personal computer toy 10 may be assembled in the manner indicated by FIG. 1. The monitor 12 is attached to the top surface 24 of the processing unit 16, and the keyboard 14 is attached to the front surface 26 of the processing unit 16. The stuffed personal computer toy 10 is now in the assembled position, where it resembles a functional personal computer in its standard configuration. The stuffed personal computer toy 10 itself may be placed on a desktop near the actual functioning computer, or it may be displayed on a shelf, etc.

At times, if the user desires, he may hug the personal computer toy, throw it, or kick it. If desired, the personal computer toy may be ripped apart, by detaching the detachable fastening mechanisms 40, thereby separating the monitor 12 and keyboard 14 from the processing unit 16.

However, the act of ripping apart the stuffed personal computer toy 10 causes no irreparable harm, and the components can be reassembled into the assembled position. Thus, the monitor 12 and keyboard 14 are reattached to the processing unit 16 by using the detachable fastening mechanisms 40, and the stuffed personal computer toy 10 is once again restored.

In conclusion, herein is presented a stuffed computer toy which provides the appearance of a functioning computer, can be torn apart if desired, and then can be restored to its original condition.

What is claimed is:

1. A stuffed computer toy, comprising:

a simulated processing unit component, substantially the shape of a rectangular prism, resembling the processing unit of a standard functioning personal computer;

a keyboard component, wedge shaped to resemble a functional computer keyboard, the keyboard component attached to the processing unit component;

a simulated monitor component, substantially cubical in shape to resemble a CRT monitor of a standard personal computer, the monitor component attached to the processing unit component; and wherein the processing unit component, the monitor component, and the keyboard component are all nonfunctioning and are each constructed of a soft material so that they may be hugged, kicked, or thrown without becoming damaged or damaging other objects; and wherein the keyboard is physically attached to the processing unit by detachable fastening means comprising hook and loop fastener components mounted on the processing unit and on the keyboard which allows the keyboard to be selectively attached and detached from the processing unit.

2. The stuffed computer toy as recited in claim 1, wherein the monitor is attached to the processing unit by hook and loop fastening components, to allow the monitor to be selectively attached and detached from the processing unit.

3. The stuffed computer toy as recited in claim 2, wherein the keyboard is attached to the processing unit on a surface of the processing unit transverse to a surface of the processing unit where the monitor is attached.

4. A stuffed computer toy method, performed using stuffed simulated keyboard, monitor, and processing unit components, the keyboard and monitor attachable to the processing unit using detachable fastening mechanisms, comprising the steps of:

attaching the keyboard and monitor to the processing unit using the detachable fastening mechanisms to form the stuffed computer toy into an assembled position;

ripping the stuffed computer toy apart by detaching the keyboard and monitor from the processing unit by detaching the fastening mechanisms; and restoring the stuffed computer toy to the assembled position by reattaching the keyboard and monitor to the processing unit using the detachable fastening mechanisms.

5. The method as recited in claim 4, wherein the detachable fastening mechanisms further comprise hook and loop fastener components.

* * * * *